US005397421A

United States Patent [19]

Fujutani

[11] Patent Number: 5,397,421

[45] Date of Patent: Mar. 14, 1995

[54] POWDER BEAM ETCHING MACHINE

[75] Inventor: Akihito Fujutani, Kanagawa, Japan

[73] Assignee: Sony Corporation, Japan

[21] Appl. No.: 134,675

[22] Filed: Oct. 12, 1993

[30] Foreign Application Priority Data

Oct. 20, 1992 [JP] Japan ..... 4-306446

[51] Int. Cl.[6] ..... C23F 1/02

[52] U.S. Cl. ..... 156/345; 156/625; 156/643; 156/646

[58] Field of Search ..... 156/345, 625, 643, 646

[56] References Cited

U.S. PATENT DOCUMENTS 5,178,683 1/1993 Takamura ..... 156/345

FOREIGN PATENT DOCUMENTS 0032637 2/1982 Japan ..... 156/345 R
0007132 1/1985 Japan ..... 156/345 RM
0055938 3/1988 Japan ..... 156/345 MM
0047030 2/1989 Japan ..... 156/345 MM
0100921 4/1989 Japan ..... 156/345 MM
0106925 4/1990 Japan ..... 156/345 R
0205020 8/1990 Japan ..... 156/345 MM
0244712 9/1990 Japan ..... 156/345 MM
3248529 11/1991 Japan ..... 156/345 MM
3253574 11/1991 Japan ..... 156/345 MM
4243121 8/1992 Japan ..... 156/345 MM

*Primary Examiner*—George Fourson
*Assistant Examiner*—Long Pham
*Attorney, Agent, or Firm*—Ronald P. Kananen

[57] ABSTRACT

In a powder beam etching machine, a etching chamber is of a double wall type with an outer sleeve and an inner sleeve. A bowl-shaped lid is provided to an inner surface of a lid to face the inner sleeve. The flow of gas containing fine particles injected from a nozzle is deflected to be led to a suction port. Thus, any stagnation of the fine particles within the etching chamber of the powder beam etching machine is avoided and any leakage of the particles to the outside is prevented. It is possible to clean a work within the etching chamber.

4 Claims, 2 Drawing Sheets

POWDER BEAM ETCHING MACHINE

BACKGROUND OF THE INVENTION

The present invention relates to a powder beam etching machine for etching a workpiece (hereinafter referred to as a work) by injecting gas containing fine particles into the work.

FIG. 3 shows an example of an arrangement of a conventional powder beam etching machine. A substrate mounting table 22 used as a work mounting table fixed in a cylindrical etching chamber 21 by a support member (not shown) is provided in the etching chamber 21 which is substantially hermetically sealed. A nozzle 24 is provided through a center of an upper wall 21*a* of the etching chamber 21 with a lower end of the nozzle 24 facing an upper surface of the substrate 23. An opening 21*b* is formed in the upper wall 21*a* for feeding and removing the substrate 23. Furthermore, a suction port 26 is provided in a bottom portion of the etching chamber 21 for collecting fine particles.

In the thus constructed power beam etching machine, an etching process is effected on a surface of the substrate by the fine particles injected together with air onto the substrate 23 from the nozzle 24.

However, in the conventional powder beam etching machine shown in FIG. 3, the fine particles which have been injected onto the substrate 23 would flow horizontally after collision, and would then collide with an inner circumferential surface of the etching chamber 21 so that part of the particles would ultimately fly upwardly. As a result, the conventional machine suffers from a problem that a large amount of fine particles would adhere to the inner circumferential surface of the etching chamber 21 and inner surfaces of the upper wall 21*a* and an upper lid 25 and a stagnation of the fine particles 27 would be formed at corner portions of the etching chamber 21. For this reason, during the etching operation, the fine particles would leak from gaps between the upper lid 25 and the upper wall 21*a*, and the fine particles would leak to the outside when the upper lid 25 is opened or closed.

The above-noted defects might be overcome by firmly fastening the upper lid 25 onto the upper wall 21*a* with some sealant. However, in this case, it is necessary to loosen or fasten screws every time substrates 23 are replaced which deteriorates working property. Also, when compressed air is sprayed onto the substrate 23 for cleaning it after the completion of the etching process, the fine particles 27 adhered or accumulated onto the etching chamber 21 would scatter again by the flow of the compressed air. As a result, it would be practically impossible to clean the substrate within the etching chamber. As a result, a discrete cleaning chamber has been conventionally provided in addition to the etching chamber. The substrate 23 which has been worked is conveyed to the cleaning chamber by using a delivery means such as a robotic arm. Then, both sides of the substrate 23 are cleaned in the cleaning chamber. As a result, various mechanisms such as a conveyor mechanism using arms, a compressed air spraying mechanism within the cleaning chamber, add an air discharging mechanisms would be needed to enlarge the system thereby increasing total cost.

On the other hand, in the case where the etching processes are to be carried out by changing kinds of fine particles, when a different kind of particles which has been used in a previous process are left in the etching chamber, different kinds of particles are mixed together to adversely affect the etching process.

SUMMARY OF THE INVENTION

According to the present invention, there is provided a power beam etching machine for injecting gas containing fine particles to a work held within an etching chamber for etching the work, which etching machine comprises: an outer sleeve having a lid portion provided openable and closable at its upper edge and an opening portion in fluid communication with an outside atmosphere in the vicinity of its lower edge; an inner sleeve provided substantially coaxially within the outer sleeve, the inner sleeve being provided with a suction port extending from a bottom surface of the outer sleeve; a bowl-shaped ceiling lid mounted to face an upper end opening portion of the inner sleeve, the bowl-shaped ceiling lid being mounted on an inner surface of the lid portion, and the bowl-shaped ceiling lid being provided with a work mounting table at a center of a lower surface thereof; and a nozzle provided axially through a center of the inner sleeve for injecting the gas containing the fine particles to the work mounted on the work mounting table.

The particles injected from the nozzle collide with the substrate to be in parallel with the substrate. Then, the particles collide with the inner circumferential surface of the ceiling lid to be deflected downwardly toward the suction portion. At this time, the suction force of the suction port is kept at a sufficient high level, so that the gas flow to be introduced from the opening portion of the outer sleeve is introduced into between the inner circumferential surface of the inner sleeve and the outer circumferential surface of the ceiling lid to smoothly deliver the particles to the suction port. As a result, there is almost no stagnation of the particles within the etching chamber. Thus, the etching process performs well.

According to another aspect of the invention, the inner sleeve has an inverted truncated cone shape. A diameter of the inner sleeve is decreased toward the lower portion. It is therefore possible to deliver the fine particles falling from the ceiling lid to the suction port.

According to still another aspect of the invention, compressed air is injected into between an inner circumferential surface of the ceiling lid and an outer circumference of the work. By the injection of the compressed air from the nozzle 10 to between the inner circumferential surface of the ceiling lid and the outer circumference of the substrate, the fine particles that might have adhered to a back surface of the substrate may be blown out.

According to still another aspect of the invention, compressed air is fed from an opening portion of the outer sleeve to an interior of the sleeve. The fine particles are positively fed to the suction port by the injection of the compressed air from the opening portion of the outer sleeve to the outer sleeve.

As described above, in the powder beam etching machine according to the invention, the ceiling lid is provided on the lid portion, and the gas flow containing the fine particles injected from the nozzle is deflected toward the suction port. It is possible to prevent the fine particles from stagnating in the etching chamber. It is also possible to clean the substrate by injecting the compression air into the etching chamber. As a result, it is possible to prevent the fine particles from leaking to the outside of the system. It is possible to suppress the contamination of the environment. Also, it is possible to change kinds of the fine particles. Furthermore, since a discrete cleaning chamber may be dispensed with, it is possible to reduce a working cost and to attain the compactness of the system. It is further advantageous that the seal in the etching chamber may be simplified and the working property for attaching and detaching the substrates may be enhanced.

in which:

1 denotes an outer sleeve;

1*a*, an opening portion;

1*b*, a bottom surface;

2, a lid portion;

8, a inner sleeve;

8*b*, an opening portion;

10, a nozzle;

11, a ceiling lid;

12, a substrate (i.e., work);

13, a substrate mounting table (i.e., work mounting table); and

14, an etching chamber.

DESCRIPTION OF THE PREFERRED EMBODIMENTS

Figure 1:
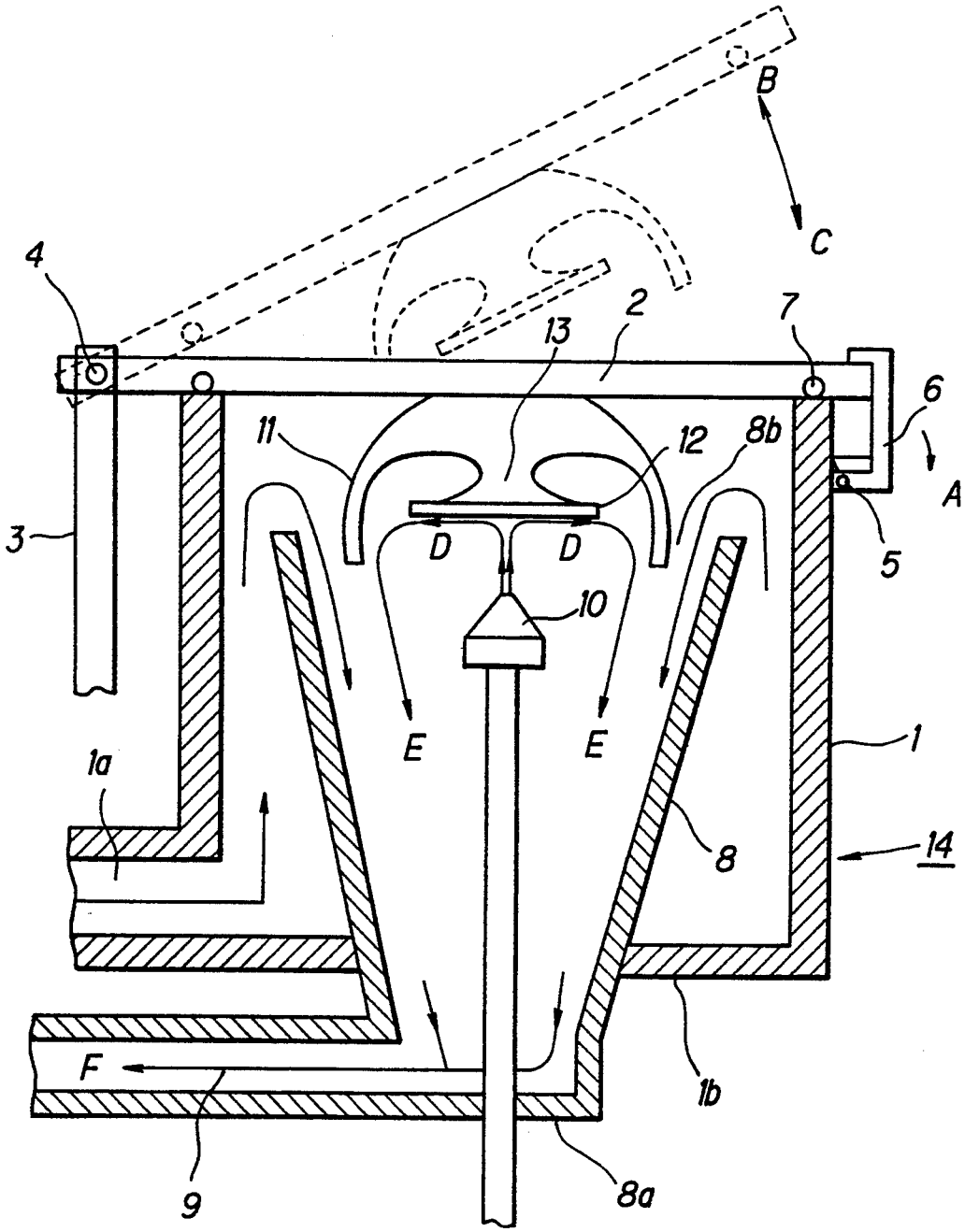
FIG. 1 is a longitudinal sectional view showing a powder beam etching machine according to one embodiment of the invention.

An arrangement according to one embodiment of the present invention is shown in FIG. 1. A lid 2 is openably provided at an upper end face of an outer sleeve 1. The lid 2 is rotatably hinged at its one edge through a shaft to an upper end of a support member 3 provided in the etching machine. The lid 2 is retained at the other edge by a lock member 6 provided rotatably through a shaft 5 at the upper peripheral portion of the outer sleeve 1. An O-ring 7 is mounted at a position where the lower surface of the lid 2 confronts with the upper end face of the outer sleeve 1. When the lid 2 is closed, the O-ring may hermetically seal the interior of the outer sleeve 1. An opening portion 1*a* in fluid communication with the atmosphere is provided in the vicinity of a lower end of the outer sleeve 1. An inner sleeve 8 is coaxially fixed within the outer sleeve 1. The inner sleeve 8 has an inverted truncated cone shape, with a lower edge of the inner sleeve projecting from a bottom 1*b* of the outer sleeve 1 and communicating with a suction port 9. A nozzle 10 is provided in an axial direction along a centerline of the inner sleeve 8. The nozzle 10 extends downwardly from a bottom surface 8*a* of the inner sleeve 8. An inverted bowl-shaped ceiling lid 11 is fixed to the center of an inner surface of the lid 2. A substrate mounting table 13 to which a substrate 12 is to be mounted is provided at the center of the inner surface of the ceiling lid 11. An upper end of the nozzle 10 faces the substrate 12 mounted on the substrate mounting table 13. The lower edge of the ceiling lid 11 is somewhat inserted into an opening 8*b* at the upper end of the inner sleeve 8. Thus, the outer sleeve 1 and the inner sleeve 8 constitute a double wall structure for the etching chamber 14.

The operation of the system according to the foregoing embodiment will now be described. When the lock member 6 is rotated in a direction indicated by an arrow A and the lid 2 is rotated in a direction indicated by an arrow B, the substrate mounting table 13 is rotated together in the same direction as in B and is directed upwardly. Accordingly, it is possible to readily attach or detach the substrate 12. When the substrate 12 is mounted on the substrate mounting table 13, and the lid 2 is rotated in a direction indicated by an arrow C and then locked by the lock member 6, the outer sleeve 1 is hermetically sealed by the O-ring 7. Subsequently, when an air flow (solid-gap two-phase flow) containing fine particles is injected from the nozzle 10 to work the surface of the substrate 12, the two-phase flow will collide with the substrate 12 to form flows indicated by arrows D in parallel with the substrate 12. Then, the two-phase flow will collide with the inner circumferential surfaces of the ceiling lid 11 to form downward flows indicated by arrows E which will be guided by the inner circumferential surface of the inner sleeve 8 to be led to the suction port 9 as indicated by an arrow F.

At this time, the force for suction of the two-phase flow through the suction port 9 is sufficiently large so that the air will flow from the opening portion la of the outer sleeve 1 into between the inner circumferential surface of the inner sleeve 8 and the outer peripheral surface of the ceiling lid 11, and the two-phase flow will be smoothly introduced into the suction port 9, thus further making smooth the two-phase flow. As a result, without stagnation of the fine particles within the etching chamber 14, it is possible to carry out the etching process. Also, in the case where kinds of the fine particles are changed, since the different kind of particles which have been previously used does not remain in the etching chamber 14, there is no fear that the different kinds of particles would be mixed together, and any adverse affect may be avoided. Furthermore, the ceiling lid 11 prevent the fine particles from adhering to the lid 2. It is therefore unnecessary to provide a strong seal during the etching process.

Figure 2:
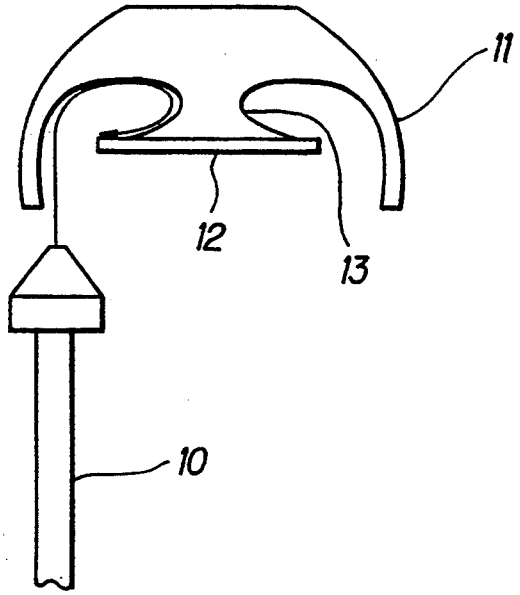
FIG. 2 is a view showing a positional relationship between the ceiling lid and the nozzle in accordance with another embodiment of the invention.
Figure 3:
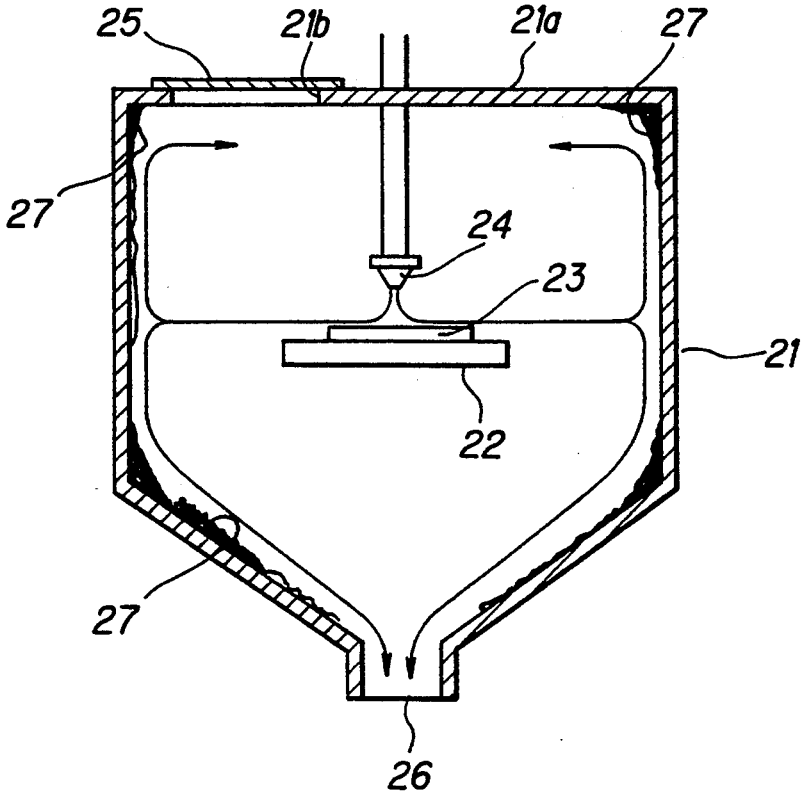
FIG. 3 (PRIOR ART)
FIG. 3 is a longitudinal sectional view showing an arrangement of a conventional powder beam etching machine.

Incidentally, it is possible to cause the fine particles adhered to the etching surface of the substrate 12 to fall apart by spraying only the compressed air onto the substrate 12 from the nozzle 10 after the completion of the etching process. Also, as shown in FIG. 2, a relative position between the ceiling plate 11 and the nozzle 10 is changed so that the tip end of the nozzle 10 faces a space between the inner circumferential surface and an outer circumference of the substrate, and the compressed air is injected from the nozzle 10, whereby the fine particles adhered to the rear surface of the substrate may be blown away. Incidentally, a blow port for the compression air may be provided between the ceiling lid 11 and the substrate mounting table 13. In this case, the compression air is blown from this blow port and at the same time, the particles are injected from the nozzle 10 to thereby shorten a time needed for cleaning process.

What is claimed is:

1. A power beam etching machine for injecting gas containing fine particles to a work held within an etching chamber for etching the work, said etching machine comprising:

an outer sleeve;

said outer sleeve having a lid portion provided openable and closable at its upper edge and an opening portion in fluid communication with an outside atmosphere in the vicinity of its lower edge; and an inner sleeve;

said inner sleeve being provided substantially coaxially within said outer sleeve, said inner sleeve being provided with a suction port extending from a bottom surface of said outer sleeve, said etching machine further comprising:

a bowl-shaped ceiling lid mounted to face an upper end opening portion of said inner sleeve, said bowl-shaped ceiling lid being mounted on an inner surface of said lid portion, and said bowl-shaped ceiling lid being provided with a work mounting table at a center of a lower surface thereof; and a nozzle provided axially through a center of said inner sleeve for injecting gas containing said fine particles to said work mounted on said work mounting table.

2. The etching machine according to claim 1, wherein said inner sleeve has an inverted truncated cone shape.

3. The etching machine according to claim 1, wherein compressed air is injected into between an inner circumferential surface of said ceiling lid and an outer circumference of said work.

4. The etching machine according to claim 1, wherein compressed air is fed from an opening portion of said outer sleeve to an interior of said outer sleeve.

* * * * *